US008733008B2

(12) United States Patent
McPherson

(10) Patent No.: US 8,733,008 B2
(45) Date of Patent: May 27, 2014

(54) LATERALLY CURVED PISTOL MAGAZINE

(71) Applicant: Taurus International Manufacturing, Inc., Miami, FL (US)

(72) Inventor: Mathew A. McPherson, Norwalk, WI (US)

(73) Assignee: Taurus International Manufacturing, Inc., Miami, FL (US)

( * ) Notice: Subject to any disclaimer, the term of this patent is extended or adjusted under 35 U.S.C. 154(b) by 0 days.

(21) Appl. No.: 13/622,299

(22) Filed: Sep. 18, 2012

(65) Prior Publication Data

US 2013/0312305 A1 Nov. 28, 2013

Related U.S. Application Data

(60) Provisional application No. 61/651,505, filed on May 24, 2012.

(51) Int. Cl.
*F41A 9/61* (2006.01)

(52) U.S. Cl.
USPC ..... 42/6; 42/7; 42/71.02; 42/71.01; 42/49.01; 42/50

(58) Field of Classification Search
USPC ..... 42/6, 7, 17, 18, 21, 22, 29, 33, 35, 37, 42/39, 49.02, 50, 52, 60, 71.01, 71.02; 124/51.1, 52; D22/103, 104
See application file for complete search history.

(56) References Cited

U.S. PATENT DOCUMENTS 105,093 A * 7/1870 Kraffert ..... 42/17
D7,933 S 12/1874 Richards
297,412 A 4/1884 Kelton
357,461 A * 2/1887 Burgess ..... 42/22
384,161 A * 6/1888 Hindley ..... 42/50
477,666 A * 6/1892 Loomis ..... 42/37
562,455 A * 6/1896 Bye ..... 42/7
566,367 A * 8/1896 Wright ..... 42/7
597,935 A * 1/1898 Ashton ..... 42/18
696,539 A * 4/1902 Bennet ..... 42/60
839,938 A * 1/1907 Lister ..... 42/7
980,980 A * 1/1911 Maggio ..... 89/147
992,854 A * 5/1911 Cobb ..... 89/147
1,042,837 A 10/1912 Tatarek
1,308,665 A * 7/1919 Douglas ..... 42/49.01

(Continued)

FOREIGN PATENT DOCUMENTS

EP 0272819 8/1993
EP 1586846 10/2005
WO 00-65293 11/2000

*Primary Examiner* — Bret Hayes
*Assistant Examiner* — Derrick Morgan
(74) *Attorney, Agent, or Firm* — Robert Curcio; DeLio, Peterson & Curcio, LLC

(57) ABSTRACT

Example cartridge magazines for use within a curved handle of certain pistols have a laterally curved housing so that the pistols and magazines can fit comfortably along a user's body. Such curved pistols and magazines are particularly suited for carrying within a shirt or pants pocket. A curved pistol loaded with a curved magazine, for instance, can be carried comfortably in one pocket while an extra loaded magazine can be carried in another pocket. Example magazines carry single and multiple rows of cartridges along appropriately sized curved housings. The magazine's curvature provides a user with a prominent tactile feature that quickly indicates in which direction the magazine should be inserted within the pistol.

10 Claims, 5 Drawing Sheets

(56) References Cited

U.S. PATENT DOCUMENTS

| | | | | | |
|---|---|---|---|---|---|
| 1,451,339 | A | * | 4/1923 | Kottas | 42/17 |
| 1,898,368 | A | | 2/1933 | Hess et al. | |
| 1,962,775 | A | | 6/1934 | Jones | |
| 2,908,987 | A | * | 10/1959 | Allyn | 42/18 |
| 3,128,571 | A | | 4/1964 | Herrett | |
| 3,276,323 | A | | 10/1966 | Dieckmann | |
| RE26,872 | E | * | 4/1970 | Diekmann | 89/195 |
| D230,974 | S | | 3/1974 | Howlett | |
| 4,058,922 | A | * | 11/1977 | Elbe et al. | 42/16 |
| D247,855 | S | | 5/1978 | Schiermeier | |
| D257,166 | S | | 9/1980 | Hogue | |
| 4,332,097 | A | * | 6/1982 | Taylor, Jr. | 42/50 |
| 4,566,212 | A | * | 1/1986 | Chesnut | 42/50 |
| 4,689,907 | A | * | 9/1987 | Gwinn, Jr. | 42/50 |
| 4,862,618 | A | | 9/1989 | Szabo | |
| 4,862,620 | A | * | 9/1989 | Chesnut et al. | 42/50 |
| 4,878,304 | A | | 11/1989 | Cupp | |
| 4,901,463 | A | * | 2/1990 | Chesnut | 42/50 |
| 4,982,520 | A | * | 1/1991 | Lee | 42/49.01 |
| 5,052,138 | A | * | 10/1991 | Crain | 42/1.02 |
| 5,406,731 | A | | 4/1995 | Stevens | |
| 5,425,299 | A | | 6/1995 | Teetzel | |
| 5,502,913 | A | * | 4/1996 | Jackson | 42/50 |
| 5,956,878 | A | | 9/1999 | Yang | |
| 6,736,125 | B2 | * | 5/2004 | Petrosyan et al. | 124/51.1 |
| 6,804,907 | B1 | | 10/2004 | Slobodkin | |
| 7,634,959 | B2 | * | 12/2009 | Frickey | 89/136 |
| 7,765,997 | B2 | * | 8/2010 | Klockener et al. | 124/48 |
| 7,823,312 | B2 | * | 11/2010 | Faifer | 42/49.02 |
| 8,006,423 | B1 | | 8/2011 | Alzamora et al. | |
| 8,186,086 | B2 | | 5/2012 | Gu-Ari et al. | |
| 8,484,875 | B2 | * | 7/2013 | Heath | 42/49.01 |
| D687,505 | S | * | 8/2013 | Knorst et al. | D22/103 |
| 2004/0107621 | A1 | * | 6/2004 | Segalle | 42/71.02 |
| 2011/0283583 | A1 | * | 11/2011 | Freed | 42/71.01 |
| 2013/0180144 | A1 | * | 7/2013 | Kresser et al. | 42/1.05 |

* cited by examiner

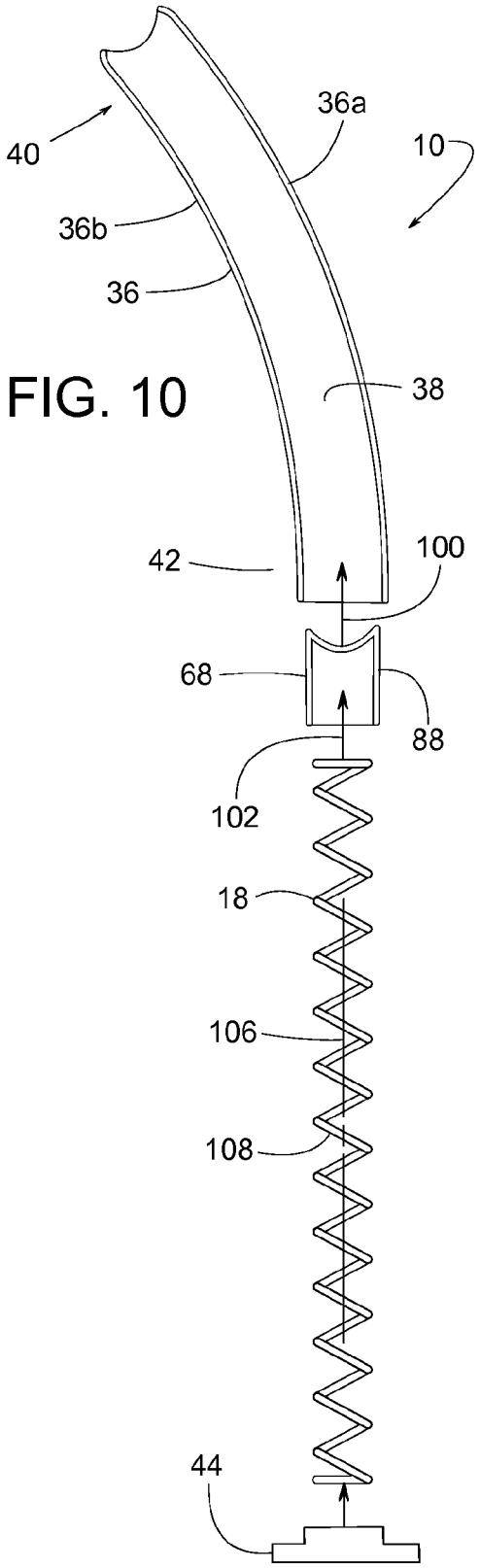
FIG. 10
FIG. 11
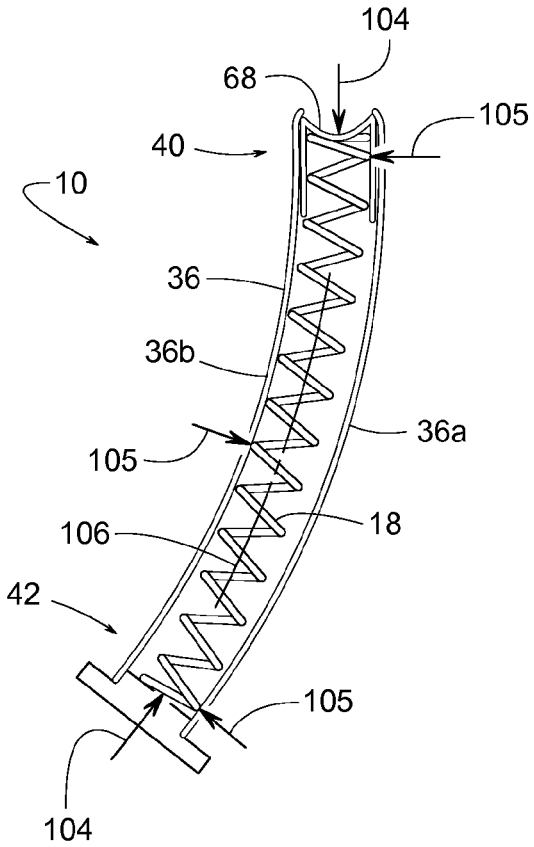
FIG. 12
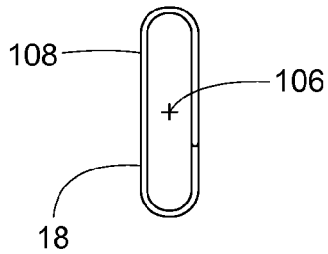

LATERALLY CURVED PISTOL MAGAZINE

CROSS REFERENCE TO RELATED APPLICATIONS

This application claims the benefit of provisional patent application Ser. No. 61/651,505 filed on May 24, 2012 by the present inventor.

FIELD OF THE DISCLOSURE

The subject invention generally pertains to handguns and more specifically to cartridge magazines for fitting within the handle of a pistol.

BACKGROUND

Pistols and revolvers are examples of handguns. A cartridge is a combination of a bullet and a shell, wherein the shell contains the gunpowder that upon ignition within the firing chamber of a handgun propels the bullet as a projectile out through the barrel of the handgun.

In the example of pistols, the firing chamber is generally integral with the barrel and usually a linear magazine within the handle grip of the pistol sequentially feeds a series of cartridges to the firing chamber. In the example of revolvers, a rotatable cylinder with a series of circumferentially distributed firing chambers align sequentially a series of cartridges with the revolver's barrel.

BRIEF DESCRIPTION OF THE DRAWINGS

FIG. 10 is a cross-sectional exploded view showing an example pistol magazine method.

FIG. 11 is a cross-sectional view similar to FIG. 4 but showing the bending and compressing of an example spring with a curved magazine.

FIG. 12 is a top end view of the spring shown in FIGS. 10 and 11.

DETAILED DESCRIPTION

FIGS. 1-13 illustrate example magazines 10 and 10' that are laterally curved for fitting within a similarly curved handle of a pistol 12 or other handgun. In the example illustrated in FIG. 1, pistol 12 has a handle 14 shaped to fit comfortably against a user's body, thus pistol 12 can be readily carried under apparel or in a pants pocket.

Figure 2:
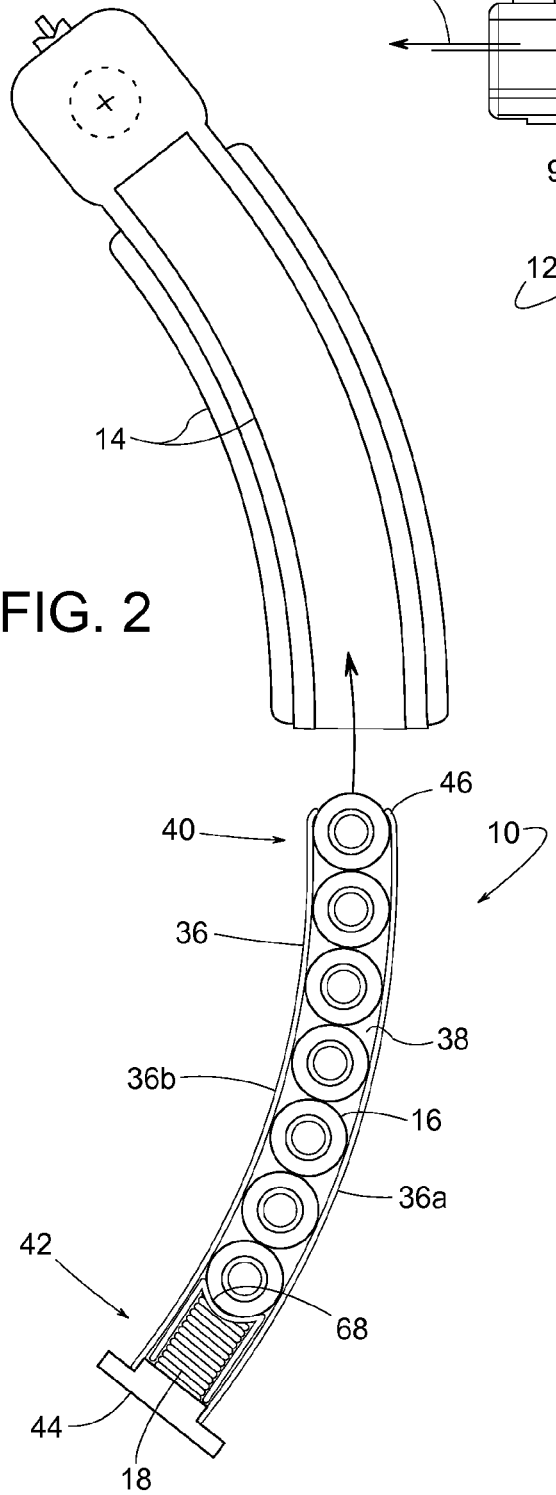
FIG. 2 is a cross-sectional exploded view of the pistol shown in FIG. 1.
Figure 3:
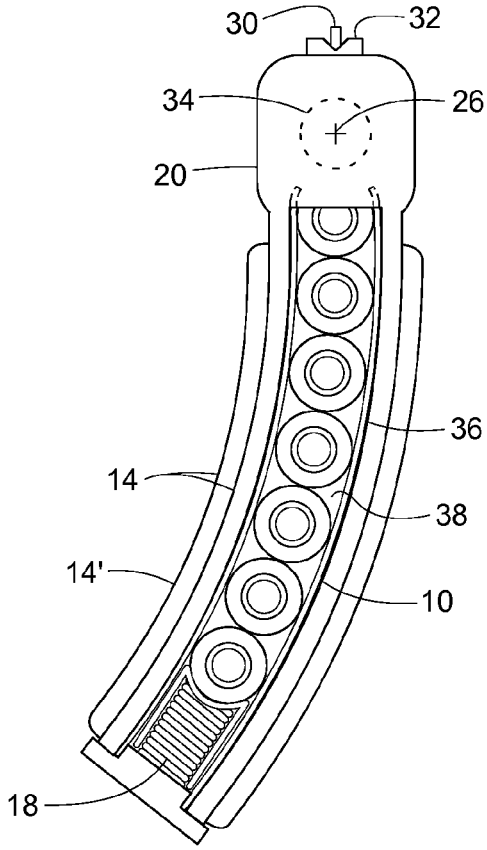
FIG. 3 is a cross-sectional view taken generally along line 3-3 of FIG. 1.
Figure 5:
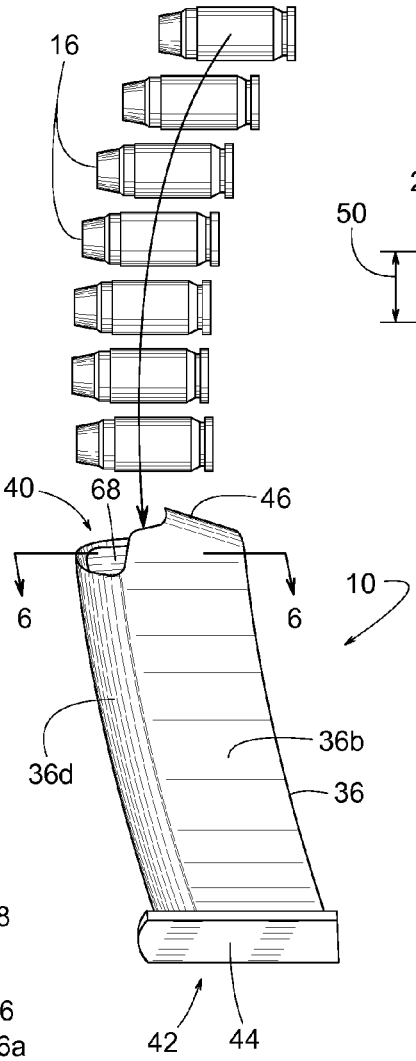
FIG. 5 is a side view of FIG. 4.
Figure 6:
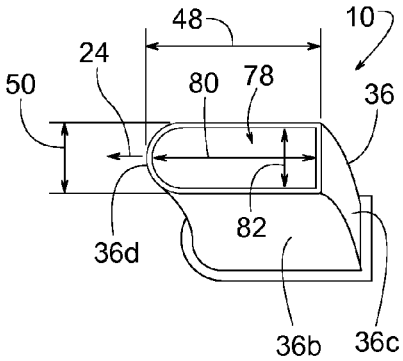
FIG. 6 is a cross-sectional view taken generally along line 6-6 of FIG. 5.
Figure 4:
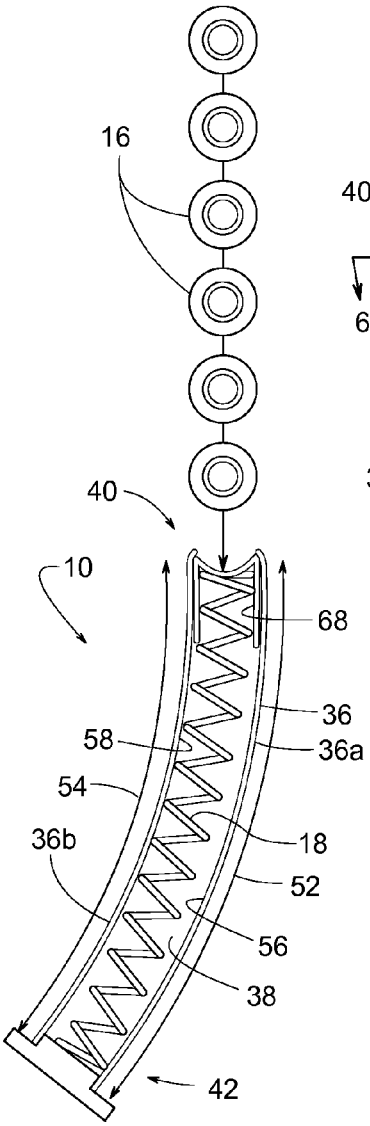
FIG. 4 is a cross-sectional view showing cartridges being inserted in the magazine of FIGS. 1-3.
Figure 7:
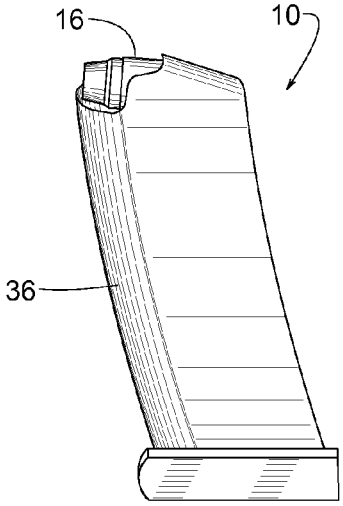
FIG. 7 is a side view similar to FIG. 5 but showing the magazine loaded with cartridges.
Figure 8:
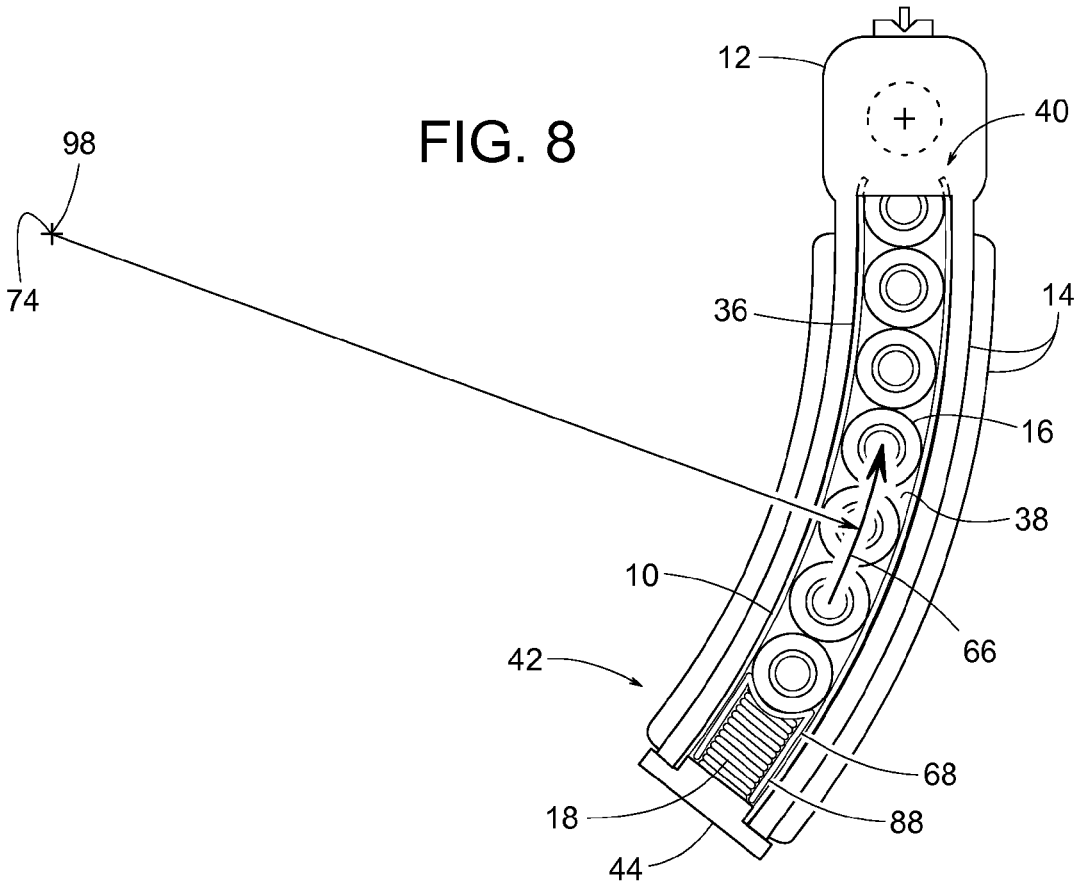
FIG. 8 is a cross-sectional view similar to FIG. 3 but identifying certain geometric features.
Figure 9:
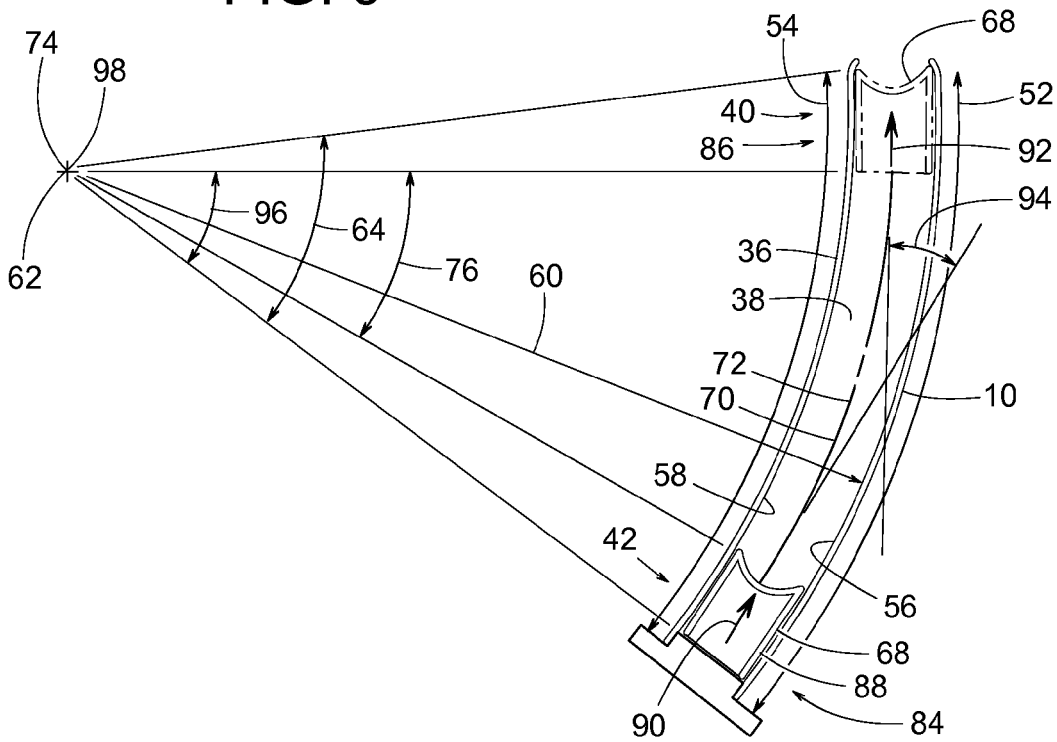
FIG. 9 is a cross-sectional view showing different positions of an example follower with an example magazine housing.
Figure 13:
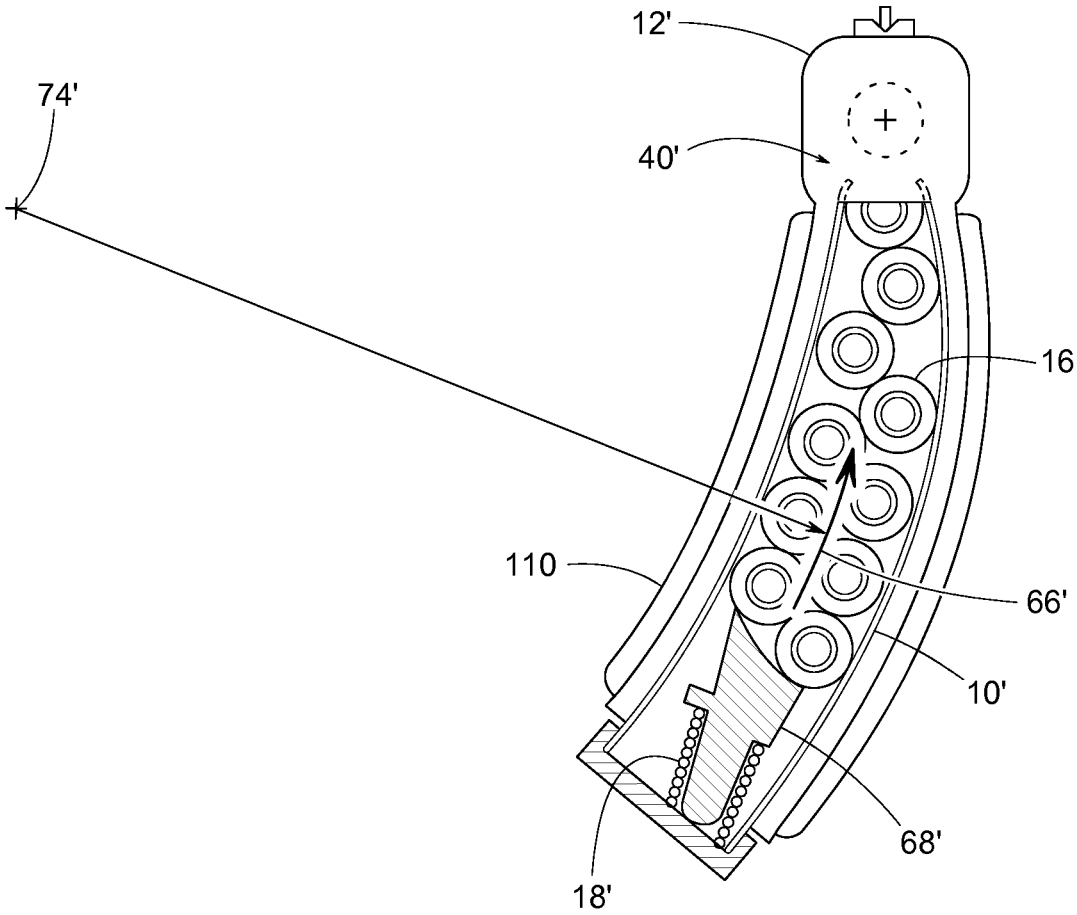
FIG. 13 is a cross-sectional view similar to FIG. 8 but showing an example magazine holding two rows of cartridges.

FIGS. 2 and 3 show pistol 12 before and after installing magazine 10. FIGS. 4 and 5 show magazine 10 being loaded with cartridges 16. FIG. 6 is a cross-sectional view taken along lines 6-6 of FIG. 5, and FIG. 7 shows a lateral side view of magazine 10 when loaded. FIGS. 8 and 9 illustrate example geometric features and methods of magazine 10. FIGS. 10 and 11 illustrate an example method of assembling magazine 10. FIG. 12 shows a top view of an example spring 18 used in some magazines. FIG. 13 shows an example magazine 10' that is laterally curved for holding and conveying two rows of cartridges 16.

Figure 1:
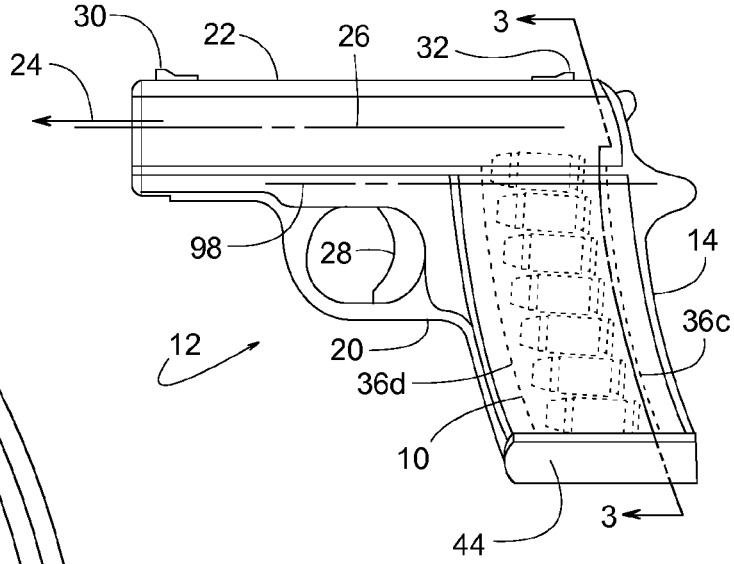
FIG. 1 is a side view of a laterally curved magazine inserted within the handle of a pistol.

Referring to the example of FIGS. 1-3, pistol 12 comprises a frame 20, a barrel 22 with a bore 34 for shooting bullets in a forward direction 24 along the barrel's longitudinal centerline 26, a trigger 28, a front sight 30, a rear sight 32, laterally curved handle 14 being attached to or extending integrally from frame 20. In some examples, handle includes a grip 14'.

Referring further to FIGS. 4-7, magazine 10, in some examples, comprises a housing 36 defining an interior chamber 38 for storing and conveying cartridges 16. Some examples of housing 36 have a first side **36*a*, a second side 36*b*, a rear edge 36*c*, a forward edge 36*d*, an open end 40 and a blocked end 42. In some examples, an end cap 44 is attached to housing 36 at blocked end 42. Open end 40 is where cartridges 16 enter and leave magazine 10. In some examples, open end 40 includes some blockage or restraining feature 46 to help hold cartridges 16 within magazine 10 until it is time for cartridge 16 to exit magazine 10. In some examples, sides 36*a* and 36*b* are wider than edges 36*c* and 36*d*. More specifically, as shown in FIG. 6, the width 48 of sides 36*a* and 36*b* is greater than the width 50 of edges 36*c* and 36*d***.

Sides **36*a* and 36*b*, and edges 36*c* and 36*d*, extend between ends 40 and 42**. The expression, "a side or edge extending between two ends" means at least a portion of the side or edge lies between the two ends but does not necessarily extend all the way to either end and is not necessarily entirely confined between the two ends. So, in some examples, a side extending between two ends also extends beyond one or both ends.

In some examples, first side **36*a* has a first contoured length 52 extending from blocked end 42 to open end 40. Second side 36*b* has a second contoured length 54 extending from blocked end 42 to open end 40. The term, "contoured length" (e.g., first length 52 and second length 54) means the length is measured along a surface rather than along a straight line through space. For a hypothetical flat element, the element's contoured length equals its straight line length measured through space. For a hypothetical non-flat element, however, the element's contoured length is greater than its straight line length measured through space. In some examples, first contoured length 52 is longer than second contoured length 54, as shown in FIGS. 2, 4 and 9**.

In some examples, first side **36*a* has a first interior surface 56 that is substantially concave along most of the first contoured length 52, and second side 54 has a second interior surface 58 facing toward first interior surface 56 and being substantially convex for most of the second contoured length 54. In other words, in some examples, a majority of first interior surface 56 is concave, and a majority of second interior surface 58 is convex. In some examples, the first contoured length 52 is at a first radius of curvature 60, and the first contoured length 52 with respect to a center point 62 of the first radius of curvature 60 extends between 0.3 and 1.2 radians (reference numeral 64**).

The term, "substantially convex" not only pertains to curved surfaces but also encompasses polygonal surfaces with a plurality of flat surface segments that are distributed along a generally convex layout. Likewise, the term, "substantially concave" not only pertains to curved surfaces but also encompasses polygonal surfaces with a plurality of flat surface segments that are distributed along a generally concave layout.

Referring further to FIGS. 8 and 9, to push cartridges 16 along a contoured path 66 through chamber 38 toward open end 40, some examples of magazine 10 include spring 18 and a follower 68, wherein spring 18 is compressed lengthwise between follower 68 and end cap 44 or between follower 68 and some other blocking feature near blocked end 42. The term, "contoured path" means that path deviates from being perfectly linear from the beginning of the path to its end. Some examples of a contoured path include, but are not limited to, a nonlinear path, a circular segment, a plurality of non-collinear straight line segments joined end-to-end, non-circular curves, and various combinations thereof. In some examples, as shown in FIGS. 8 and 9, a longitudinal centerline 70 of contoured path 66 includes a substantially circular segment 72 having center of curvature 74 at point 62, wherein the substantially circular segment 72 extends between 0.3 and 1.2 radians (reference numeral 76) with respect to center of curvature 74.

In some examples, chamber 38 has a cross-section 78 (e.g., the chamber's cross-section as viewed across line 6-6 of FIG. 5) perpendicular to path 66. Cross-section 78, in some examples, has a length 80 extending in forward direction 24 and a width 82 extending perpendicular to forward direction 24. Length 80 extends generally along the housing's first side 36*a*, width 82 extends between sides 36*a* and 36*b*, and length 80 is greater than width 82.

FIGS. 8 and 9 show follower 68 being movable along contoured path 66 between a fully loaded position 84 (e.g., FIGS. 2, 3, 8 and 9) and an unloaded position 86 (e.g., FIGS. 4, 9 and 11). In some examples, follower 68 has a side surface 88 that touches and slides along the housing's interior surfaces 56 and/or 58. Follower 68 in unloaded position 86 is proximate open end 40. Follower 68 in fully loaded position 84 is closer to blocked end 42 than to open end 40. As follower 68 travels along contoured path 66, the follower's travel direction changes from an initial travel direction 90 proximate blocked end 42 and a final travel direction 92 proximate open end 40. In the illustrated examples, contoured path 66 provides a limited variation 94 in travel direction between initial travel direction 90 and final travel direction 92. The term, "limited variation" means less than 360 degrees. In some examples, the limited variation 94 in travel direction is greater than zero (0) degrees and less than ninety (90) degrees.

In some examples, as shown in FIG. 9, follower 68 relative to housing 36 has a first rotational orientation when follower 68 is at fully loaded position 84, and follower 68 has a second rotational orientation when follower 68 is at unloaded position 86. The first rotational orientation and the second rotational orientation define therebetween a limited range of rotation 96 of follower 68 relative to housing 36. In the illustrated example, the limited range of rotation 96 is about a rotational axis 98 extending in forward direction 24, wherein the limited range of rotation 96 is greater than zero (0) degrees and less than ninety (90) degrees. The term, "axis 98 extending in forward direction 24" means that axis 98 is not perpendicular to forward direction 24 and does not necessarily mean that axis 98 is parallel to or collinear with forward direction 24. In some examples, axis 98 is substantially parallel to forward direction 24.

Arrow 66 shown in FIG. 8 represents conveying the plurality of cartridges 16 along curved path 66 within handle 14 of pistol 12, wherein some examples of curved path 66 have a center axis of curvature that is non-perpendicular to the barrel's longitudinal centerline 26. It should be noted that perpendicular does not necessarily mean the lines intersect, as some lines are spaced apart non-intersecting perpendicular lines. FIGS. 3, 4 and 5 illustrate arranging the plurality of cartridges 16 in a single curved row within handle 14. FIG. 13 illustrates arranging a plurality of cartridges 16 in a plurality of rows guided along a contoured path 66' through a curved handle 110 of a pistol 12', wherein path 66' curves about point 74'. FIG. 13 also shows a spring 18' and a follower 68' for pushing cartridges 16 toward open end 40'.

In some examples, assembly of magazine 10 is as shown in FIGS. 10, 11 and 12. FIG. 10 shows the assembly of various parts, FIG. 11 shows spring 18 being compressed lengthwise and bent laterally, and FIG. 12 shows a top end view of spring 18 prior to being bent within housing 36. Arrow 100 represents inserting follower 68 into housing 36. Arrow 102 represents inserting spring 18 into housing 36. Arrows 104 represent compressing spring 18 within housing 36 between follower 68 and blocked end 42. Arrows 105 represent bending spring 18 sideways against second side 36*b* of housing 36.

Spring 18, in some examples, has a longitudinal centerline 106 that is straighter prior to inserting spring 18 into housing 36. Note, longitudinal centerline 106 is shown straighter in FIG. 10 than in FIG. 11. Bending spring 18 laterally against side 36*b* of housing 36 helps prevent spring 18 from rattling around within housing 36. A pistol free of rattling noise is a benefit in some situations. In some examples, spring 18 comprises an elongate element 108 (e.g., a wire) helically disposed about longitudinal centerline 106.

Although the invention is described with respect to a preferred embodiment, modifications thereto will be apparent to those of ordinary skill in the art. The scope of the invention, therefore, is the be determined by reference to the following claims:

The invention claimed is:

1. A magazine for fitting within a curved handle of a pistol, the magazine comprising:

a curved housing being substantially inserted within said curved handle, said curved housing having a first side, a second side, an open end and a blocked end, the housing defining a chamber flanked by the first side and the second side, the chamber providing a nonlinear path running between the open end and the blocked end, the chamber having a cross-section perpendicular to the nonlinear path, the cross-section having a length extending in a forward direction and a width extending perpendicular to the forward direction, the length extending along the first side, the width extending between the first side and the second side, the length being greater than the width;

a follower disposed within the chamber, the follower being movable along the nonlinear path between a fully loaded position and an unloaded position, the follower in the unloaded position being proximate the open end, the follower in the fully loaded position being closer to the blocked end than to the open end, the follower relative to the housing having a first rotational orientation when the follower is at the fully loaded position, the follower relative to the curved housing having a second rotational orientation when the follower is at the unloaded position, the first rotational orientation and the second rotational orientation defining therebetween a limited range of rotation of the follower relative to the curved housing, the limited range of rotation being about a rotational axis extending in the forward direction, the limited range of rotation being greater than zero degrees and less than ninety degrees; and a spring disposed within the chamber and being compressed between the follower and the blocked end of the curved housing, the spring urging the follower along the nonlinear path toward the open end of the housing.

2. The magazine of claim 1, wherein the first side has a first interior surface, the second side has a second interior surface facing toward the first interior surface, the side surface of the follower touches the first interior surface, a majority of the first interior surface is concave, and a majority of the second interior surface is convex.

3. The magazine of claim 2, wherein the majority of the first interior surface that is concave has a first contoured length at a first radius of curvature, and the first contoured length with respect to a center point of the first radius of curvature extends between 0.3 and 1.2 radians.

4. The magazine of claim 1, wherein the first side has a first contoured length extending from the open end to the blocked end, the second side has a second contoured length extending from the open end to the blocked end, the first contoured length is longer than the second contoured length.

5. The magazine of claim 1, wherein a longitudinal centerline of the nonlinear path includes a substantially circular segment having a center of curvature, wherein the substantially circular segment extends between 0.3 and 1.2 radians with respect to the center of curvature.

6. A magazine for fitting within a curved handle of a pistol, the magazine comprising:

a curved housing for insertion within said handle, said curved housing having a first side, a second side, a rear edge, a forward edge, an open end and a blocked end, the first side and the second side being wider than the forward edge and the rear edge, each of the first side, the second side, the rear edge and the forward edge extending between the open end and the blocked end, the first side having a first contoured length extending from the blocked end to the open end, the first side having a first interior surface that is substantially concave along most of the first contoured length, the second side having a second contoured length extending from the blocked end to the open end, the second side having a second interior surface facing toward the first interior surface and being substantially convex for most of the second contoured length;

a follower disposed within a chamber defined by the curved housing, the follower being movable along a contoured path between a fully loaded position and an unloaded position, the follower in the unloaded position being proximate the open end, the follower in the fully loaded position being closer to the blocked end than to the open end, the contoured path defining an initial travel direction proximate the blocked end, the contoured path defining a final travel direction proximate the open end, the contoured path providing a limited variation in travel direction between the initial travel direction and the final travel direction, the limited variation in travel direction being greater than zero degrees and less than 90 degrees; and a spring disposed within the chamber and being compressed between the follower and the blocked end of the curved housing, the spring urging the follower along the contoured path toward the open end of the curved housing.

7. The magazine of claim 6, wherein a majority of the first interior surface is concave, and a majority of the second interior surface is convex.

8. The magazine of claim 7, wherein the majority of the first interior surface that is concave has a first contoured length at a first radius of curvature, and the first contoured length with respect to a center point of the first radius of curvature extends between 0.3 and 1.2 radians.

9. The magazine of claim 6, wherein the first side has a first contoured length extending from the open end to the blocked end, the second side has a second contoured length extending from the open end to the blocked end, the first contoured length is longer than the second contoured length.

10. The magazine of claim 6, wherein a longitudinal centerline of the contoured path includes a substantially circular segment having a center of curvature, wherein the substantially circular segment extends between 0.3 and 1.2 radians with respect to the center of curvature.

* * * * *